United States Patent [19]

Lenk et al.

[11] Patent Number: 4,890,800

[45] Date of Patent: Jan. 2, 1990

[54] YARN WITHDRAWAL APPARATUS AND METHOD

[75] Inventors: Erich Lenk, Remscheid; Albert Stitz, Kurten, both of Fed. Rep. of Germany

[73] Assignee: Barmag, AG, Remscheid, Fed. Rep. of Germany

[21] Appl. No.: 218,089

[22] Filed: Jul. 12, 1988

Related U.S. Application Data

[63] Continuation-in-part of Ser. No. 38,334, Apr. 14, 1987, Pat. No. 4,817,880, which is a continuation-in-part of Ser. No. 8,490, Jan. 29, 1987, Pat. No. 4,784,344.

[30] Foreign Application Priority Data

Jul. 30, 1987 [DE] Fed. Rep. of Germany ..... 3725208

[51] Int. Cl.[4] ..... B65H 51/20

[52] U.S. Cl. ..... 242/47.01; 226/97; 226/108; 242/18 R; 242/47; 242/47.12; 28/289

[58] Field of Search ..... 242/47.01, 47.03, 47.04, 242/47.05, 47.06, 47.07, 47.08, 47.09, 47.1, 47.11, 47.12, 47.13, 47, 18 R, 18 A, 18 PW; 226/184, 168, 97, 108; 28/289

[56] References Cited

U.S. PATENT DOCUMENTS

| | | | |
|---|---|---|---|
| 1,962,029 | 6/1934 | Murphy et al. | 226/184 X |
| 2,350,182 | 5/1944 | Neff | 242/47.03 |
| 2,539,978 | 1/1951 | Van Dijk | 226/184 X |
| 2,667,052 | 1/1954 | Lebocey | 242/47.01 X |
| 2,744,399 | 5/1956 | West | 242/47.12 X |
| 2,885,257 | 5/1959 | Courtney et al. | 226/97 |
| 2,929,179 | 3/1960 | George | 28/289 X |
| 3,083,924 | 4/1963 | Vossen et al. | 242/47.12 |
| 3,144,187 | 8/1964 | Naumann | 226/97 X |
| 3,272,416 | 9/1966 | Emery | 226/97 |
| 3,433,424 | 3/1969 | Rover et al. | 242/47 |
| 3,706,407 | 12/1972 | King et al. | 226/97 |
| 3,912,185 | 10/1975 | Yamada | 242/47.03 |
| 3,917,141 | 11/1975 | Sartori | 226/97 |
| 3,957,217 | 5/1976 | Clemens | 242/47.01 |
| 4,127,983 | 12/1978 | Munker | 226/97 X |
| 4,638,955 | 1/1987 | Schippers et al. | 242/18 PW |

FOREIGN PATENT DOCUMENTS

| | | |
|---|---|---|
| 1911735 | 6/1970 | Fed. Rep. of Germany . |
| 2633474 | 2/1978 | Fed. Rep. of Germany . |
| 2939716 | 4/1981 | Fed. Rep. of Germany . |
| 3115371 | 2/1982 | Fed. Rep. of Germany . |
| 2302951 | 10/1976 | France . |
| 861140 | 2/1961 | United Kingdom . |
| 1057118 | 2/1967 | United Kingdom . |

OTHER PUBLICATIONS

UK Patent Application GB 2,169,927A; Filed Jan. 6, 1986; Published Jul. 23, 1986.

UK Patent Application GM 2,092,188A; Filed: Jun. 30, 1981; Published Aug. 11, 1982.

European Patent Application No. 0,185,131; Filed Apr. 22, 1985; Published Jun. 25, 1986.

*Primary Examiner*—Stanley N. Gilreath

*Attorney, Agent, or Firm*—Bell, Seltzer, Park & Gibson

[57] ABSTRACT

A yarn withdrawal apparatus and method is disclosed for temporarily withdrawing a freshly spun and continuously advancing yarn to a waste container when the spinning operation is interrupted, and for thereafter threading the yarn onto the feed godet or winder of the spinning machine. The apparatus comprises a yarn advancing means in the form of a rotating tapered roll, which is adapted to have the yarn looped thereabout. The tapered roll comprises a yarn inlet portion and a yarn exit portion, with the inlet portion being designed to initially contact the advancing yarn. The cone angle of the inlet portion is predetermined so as to cause the yarn to initially engage the rotating roll without lateral slippage and thereby permit the rotating roll to exert a strong tension on the yarn. The yarn subsequently slips laterally along the yarn inlet portion of the roll and toward the yarn exit portion, and it is then tangentially withdrawn from the roll. The yarn exit portion of the roll has a cone angle which is predetermined to prevent the yarn from sliding therealong to the end of the roll.

33 Claims, 6 Drawing Sheets

6
11
1.2
1.1
22
23
21
7
1
5.2
9
10
14
20
8
17
18
5.1
4
2
3
5
1.3
12
24
16
25
25
α
β
γ

6
11
7
1
5.2
9
14
20
8
18
5.1
4
2
3
5
1.3
1.2
1.1
16
β
γ
22
23
21
21
24

20
18
14
5.1
2
5
16
22
24
20

YARN WITHDRAWAL APPARATUS AND METHOD

CROSS-REFERENCE TO RELATED APPLICATIONS

The present application is a continuation-in-part of copending application Ser. No. 038,334, filed Apr. 14, 1987, now Pat. No. 4,817,880 which in turn is a continuation-in-part of copending application Ser. No. 008,490, filed Jan. 29, 1987, now U.S. Pat. No. 4,784,344.

BACKGROUND OF THE INVENTION

The present invention relates to an apparatus and method for withdrawing a continuously advancing yarn by means of a suction air current, and conveying the yarn without any tension to a receiving means, such as a waste container, or to a continuously moving belt or screen upon which the yarn is deposited to form a felt-like or web-like non-woven structure. More particularly, the present invention relates to an apparatus and method which is adapted for withdrawing an advancing yarn from a spinneret under definite tension, and so as to permit the yarn to be conveyed without tension, and to be withdrawn, however, under a tension high enough so that the yarn can be threaded onto the feed godet or winding device of the spinning machine.

The above copending applications disclose apparatus of the described type and which are adapted to apply a relatively high yarn tension to the advancing yarn, even at yarn speeds of up to 4,000 meters per minute and above, and so that one or more yarns may be withdrawn without difficulty. The yarn, however, is delivered without tension and may be supplied to a suitable transport means such as a screen or a belt or to a waste container. The apparatus of the prior applications are particularly suitable for withdrawing yarns which are delivered at a constant speed, i.e., for withdrawing yarns from a spinneret or draw rolls and for threading the yarns onto godet feed rolls or winding machines.

It is an object of the present invention to provide an apparatus and method for withdrawing a continuously advancing yarn for the described purposes, and which represents a further improvement over the conventional suction devices.

It is a more particular object of the present invention to provide an apparatus and method for the withdrawal of a continuously advancing yarn which is adapted for reliable use with a wide range of yarn constructions and materials, and without adaptation or modification of the apparatus.

SUMMARY OF THE INVENTION

These and other objects and advantages of the present invention are achieved in the embodiments illustrated herein, by the provision of an apparatus which comprises a support, a tapered yarn winding roll mounted to said support for rotation about a central axis, and which includes a yarn entry portion and a yarn exit portion, with the yarn entry portion having a cone angle which is greater than the cone angle of the yarn exit portion. The apparatus also comprises yarn inlet means for guiding the advancing yarn substantially tangentially onto said roll at said yarn entry portion, yarn outlet means for withdrawing the advancing yarn substantially tangentially from said roll at a withdrawal location axially spaced from said inlet means in a direction toward said yarn exit portion, and drive means mounted to said support for rotating said roll about the central axis at a rate such that the initial point of contact of the yarn upon said yarn entry portion has a linear speed at least equal to that of the advancing yarn.

In accordance with the present invention, the cone angle of said yarn entry portion has a tangent which is less than the coefficient of static friction between the yarn and the surface of the roll but greater than the coefficient of sliding friction, and the cone angle of said yarn exit portion has a tangent which is less than the coefficient of sliding friction. These conditions result in the yarn initially engaging the rotating roll without lateral slippage to thereby permit the rotating roll to exert a strong tension on the yarn. The yarn then slips laterally along the yarn inlet portion, but it is not able to slip along the yarn exit portion and to the end of the roll.

The present invention accordingly recognizes that the friction of the yarn on the surface of the roll may differ in the longitudinal and transverse or lateral directions. Within the scope of the present invention, it is the friction in the transverse or lateral direction that is dealt with. The friction in the transverse direction depends upon a plurality of friction parameters, such as the construction and preparation of the yarn. The construction includes the chemical composition, the physical structure, the temperature, etc. The preparation involves the preparation and finishing fluids which adhere to the yarn surface. Also involved in the frictional characteristics of a yarn are the total denier, the number of filaments, the denier of the individual filaments, as well as the external configuration of the filaments. It therefore results that the coefficient of static friction and the coefficient of sliding friction are each specifically related to the yarn. Further, the surface condition and the surface material of the roll are factors which effect the coefficient of friction. In the case of usual materials for the roll, such as for example steel and aluminum, the coefficient of static friction for a wide variety of yarns is typically less than about 0.4 and 0.8. The coefficient of sliding friction is typically less than a value between about 0.2 and 0.3. Thus in the case of these usual materials, the cone angle of the entry portion has a tangent between about 0.2 and 0.7, and preferably not greater than about 0.4. In case the coefficients of friction are in the above-named ranges, the cone angle of the entry portion may be between 11.5° and 14° corresponding to a tangent between 0.2 and 0.25, whereas the cone angle of the exit portion has a tangent which is less than about 0.2, and preferably between about 0.1 and 0.18

In accordance with the present invention, and without regard to the amount of the coefficient of friction of each yarn to be withdrawn, a reliable performance of the yarn withdrawal apparatus is achieved in that the roll by which the yarn is withdrawn consists of two portions, namely, a yarn entry portion which is located in the yarn entry area and which has a more steep inclination with respect to the axis of rotation (i.e. cone angle) than does the yarn exit portion. The tangent of the cone angle is less than the lowest coefficient of static friction realistically occurring in operation for a given variety of yarn characteristics and for the chosen surface material of the roll. Also, the tangent of the cone angle is greater than the highest coefficient of sliding friction which may be expected to be present under the usual operating parameters. The yarn exit portion is located in the area at which the yarn is withdrawn from the roll, and its cone angle is selected to have a tangent which is less than the lowest coefficient of sliding friction with respect to the assumed yarn characteristics and operating parameters.

The above described construction of the rotating roll of the yarn withdrawal apparatus causes the yarn to initially engage the rotating roll without lateral slippage immediately upon contact with the yarn entry portion of the roll so as to permit the rotating roll to exert a strong tension on the advancing yarn. In other words, the yarn initially contacting the yarn entry portion is not able to slide laterally in the direction of the taper as a result of its own tension, but only as a result of transverse forces, which permits the roll to exert a strong tension on the yarn. Only when the yarn has wrapped the roll in one normal plane at a large wrapping angle and if approaching the yarn outlet means for withdrawing the yarn substantially tangentially from said roll, such transverse forces are exerted on the yarn forcing the yarn to slide laterally in the direction of the exit portion. Also, the yarn cannot move along the roll in the opposite direction, i.e. upstream and away from the yarn exit portion, and in addition, the yarn cannot slide along the yarn exit portion and off the roll since a high degree of static friction exists. As a result, the yarn partially loops the roll and always moves up to the interface between the yarn exit portion and the yarn entry portion, so that the yarn withdrawal consistently occurs at that location.

The yarn entry portion and the yarn exit portion of the roll may each be conical. Alternatively, the yarn entry portion may be conical and the yarn exit portion substantially cylindrical. As a still further embodiment, the yarn entry portion and the yarn exit portion may be composed of a smoothly curved and tapered surface, such as a hyperbola, parabola, or a circular arc, with the indicated inclinations, when viewed in the axial section. In this later case, the plane at which the yarn exits the roll regulates itself as a function of the friction parameters of the individual yarn. Thus in accordance with the invention the yarn exit plane regulates itself constantly, and the yarn is not able to slide by itself down to the end of the roll. Similarly, the yarn is not able to move from the plane at which the yarn contacts the roll upstream to the larger diameter end of the roll.

To establish a defined yarn exit plane for yarns of various characteristics, provision may be made that the interface between the yarn entry portion and the yarn exit portion define a distinct discontinuity, i.e. a sharp edge or angle, so that a distinct transition of the inclination exists. It is possible that the two portions of the roll may be formed by curved surface lines. However, as noted above, the yarn entry portion may be conical and the yarn exit portion may be either conical or cylindrical. Where a distinct discontinuity exists, the yarn exit plane will be defined by the normal plane which includes the discontinuity, and the yarn outlet means preferably will be arranged in that normal plane.

In the preferred embodiments, the means for guiding the yarn onto the roll comprises means for directing an air current inwardly through an inlet opening in a housing which surrounds the roll, and the means for withdrawing the yarn from the roll comprises means for directing an air current or suction outwardly through an outlet opening in the housing. The suction of the yarn need not necessarily be located in the yarn exit plane, since according to the present invention, the yarn exit plane is stable and thus a deflection of the yarn is possible as it is withdrawn from the roll. To prevent additional yarn tension from building up as a result of such deflection, the suction may however be placed directly in the yarn exit plane.

As a further aspect of the present invention, a simplified thread-up of the yarn may be achieved wherein the housing is composed of two sections which are joined to each other for relative rotation about the axis of the roll. The sections are divided along a normal plane which is located in the area of the yarn entry portion, and both housing sections are rotatable relative to each other by 360°. Also, the yarn inlet opening is mounted on one of the sections, and the yarn outlet opening is mounted on the other of the sections. In a first rotated position, the yarn entry opening and the yarn exit opening are opposite to each other in a tangential plane or in the plane of a secant to the roll or to the housing. When the yarn is brought into the yarn entry opening, it is guided past the roll without looping, or with only a slight looping, and then entrained by the suction air current of the yarn outlet opening. One housing section is then rotated relative to the other by about 360°, causing the yarn to be looped about the roll by about 360°.

In another aspect of the present invention, the yarn inlet means comprises an inlet opening in the housing and the yarn outlet means comprises an outlet opening in the housing, with the inlet opening and the outlet opening being circumferentially offset by an angle less than 360°, measured in the sense of rotation of the roll. It is thereby assured that the yarn sucked into the inlet opening of said housing forms a proper loop around said roll rather than to directly move from said inlet opening to the outlet opening without looping around the roll. It is, furthermore, avoided that the portion of the yarn looping around the roll is caught and pressed against the roll by that portion of the yarn entering the inlet opening and running onto the roll. The circumferential distance between the inlet and outlet openings is preferably between about 280° and 340°.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
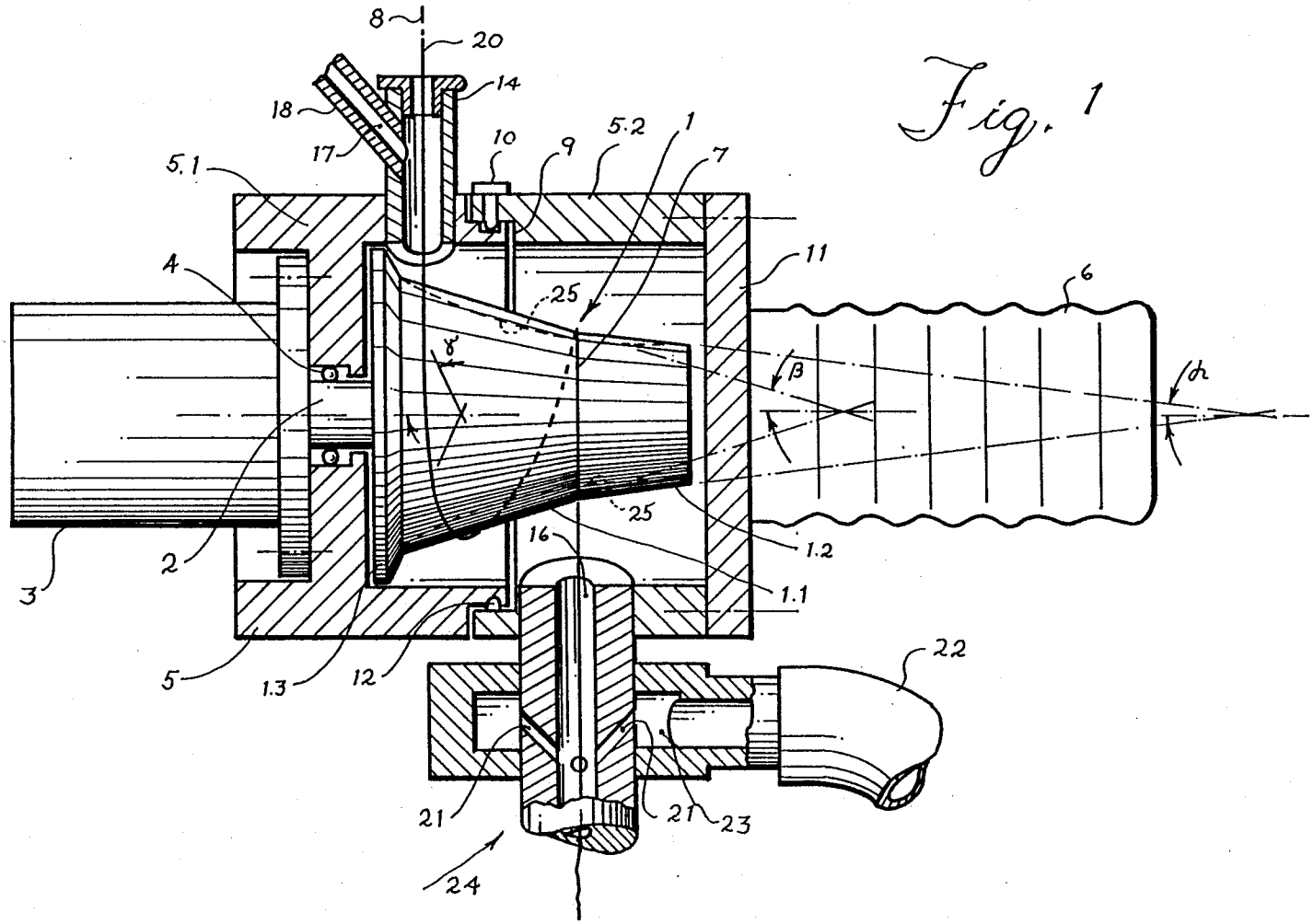
FIG. 1 is a partly sectioned side elevation view of a yarn withdrawal apparatus in accordance with the present invention.

Referring initially to the embodiment of FIG. 1, there is disclosed a yarn withdrawal apparatus which comprises a tapered roll 1 having a drive shaft 2 which is rotatably supported in a bearing 4, and with the bearing in turn being mounted in a cylindrical housing 5 which defines an internal chamber which encloses the roll 1. The roll 1 is thus supported at one end by the shaft 2 for rotation about the axis of the shaft 2, and it is rotatably driven by a motor 3. At the opposite end, the housing is closed by a cover plate 11, and a handle 6 is attached to the cover plate 11 to permit manual manipulation of the apparatus. A yarn inlet opening 14 is mounted to the housing 5 and the opening 14 is provided with injectors 17 which are supplied with compressed air via an air connection 18. The injectors 17 thus create a suction current in the inlet opening.

Figure 3:
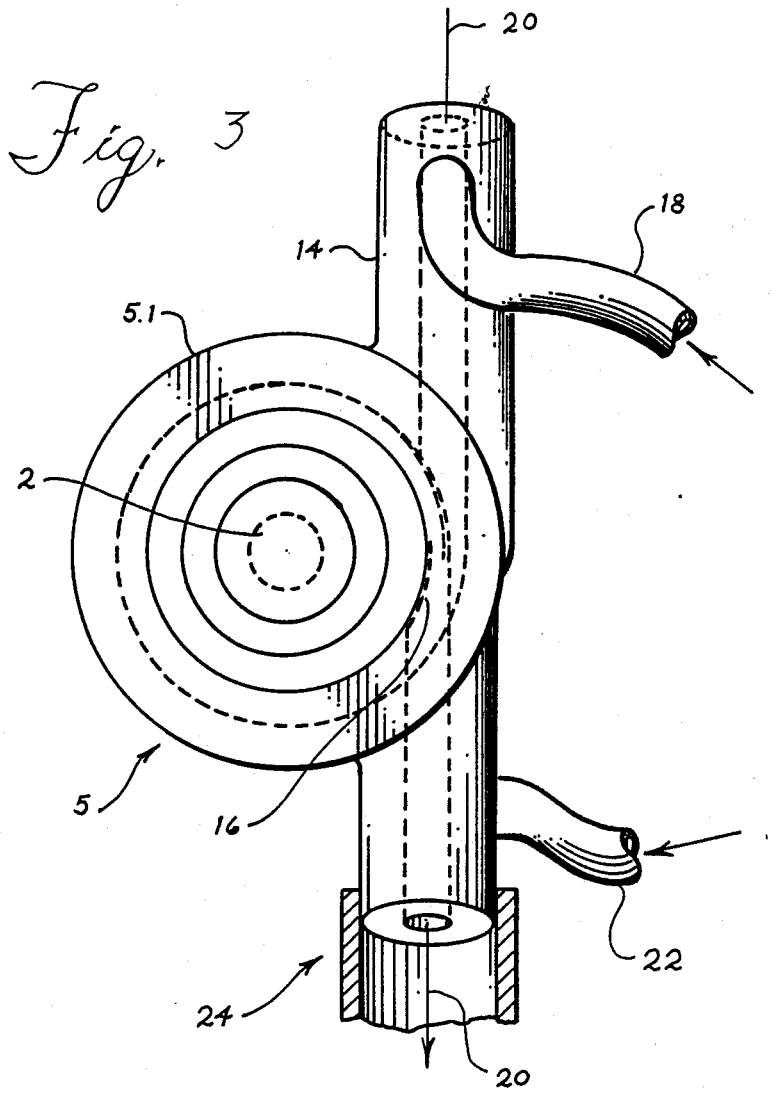
FIG. 3 is an end view of the apparatus shown in FIG. 2, but with slightly modified yarn inlet and outlet structures.

In about the same tangential plane as, however, axially displaced from the yarn inlet opening 14 and located on the other side of the housing, is a suction or outlet opening 16, to which a suction device 24 is connected. The outlet opening 16 leads to a waste container (not shown). The suction device 24 includes a tube having a plurality of injector nozzles 21 which are arranged in the pattern of an imaginery cone. The injector nozzles 21 receive compressed air via an air connection 22 and an annular duct 23 which surrounds the tube at the location of the injector nozzles. The nozzles 21 thus generate a suction current which withdraws air from the housing. As is shown in FIG. 3, the yarn inlet opening 14 and the yarn outlet opening 16 are preferably located substantially in a tangential plane with respect to the cylindrical wall of the housing 5.

The roll 1 comprises three distinct sections. First, the large diameter end portion of the roll includes a collar 1.3 which is located between the normal plane 8 along which the yarn 20 advances and the drive shaft 2. The collar 1.3 prevents the yarn and individual filaments from entering into the bearing. The cone angle gamma of this collar is sufficiently steep so that the yarn or filaments contacting the same will in any event slide off. In this regard, the cone angle is defined as the angle lying in an axial plane and between a surface line and the axis of rotation of the cone.

The roll 1 secondly comprises a yarn inlet portion 1.1 which is adjacent the collar 1.3. The portion 1.1 is of conical configuration and has a cone angle beta. Thirdly, the roll 1 includes a yarn exit portion 1.2 which has a smaller cone angle alpha as shown in FIG. 1, and which is cylindrical in the embodiment of FIG. 2.

The cone angles of the portions 1.1 and 1.2 of the roll are determined as follows. The cone angle beta of the yarn entry portion 1.1 is such that there is sliding friction of any yarn therealong. In other words, the portion 1.1 in the direction of taper only when a sliding movement has commenced. The yarn advancing to the yarn inlet portion 1.1 without a relative movement adheres to the roll initially, but as soon as a lateral sliding has commenced, the yarn continues to slide under its own tension. Sliding is initiated by the lateral withdrawing force.

There exists a certain range for both the coefficient of static friction and the coefficient of sliding friction which is dependent upon the several parameters noted above. Consequently, the upper limit of the angle beta is determined by the lowest occurring coefficient of static friction of a yarn in question relative to the chosen surface. The lower limit of the angle beta is determined by the highest occurrence of sliding friction of a yarn in question relative to the chosen surface of the roll. The inclination of the yarn exit portion 1.2 is selected so that there is an adherence of the yarn in any event.

Figure 2:
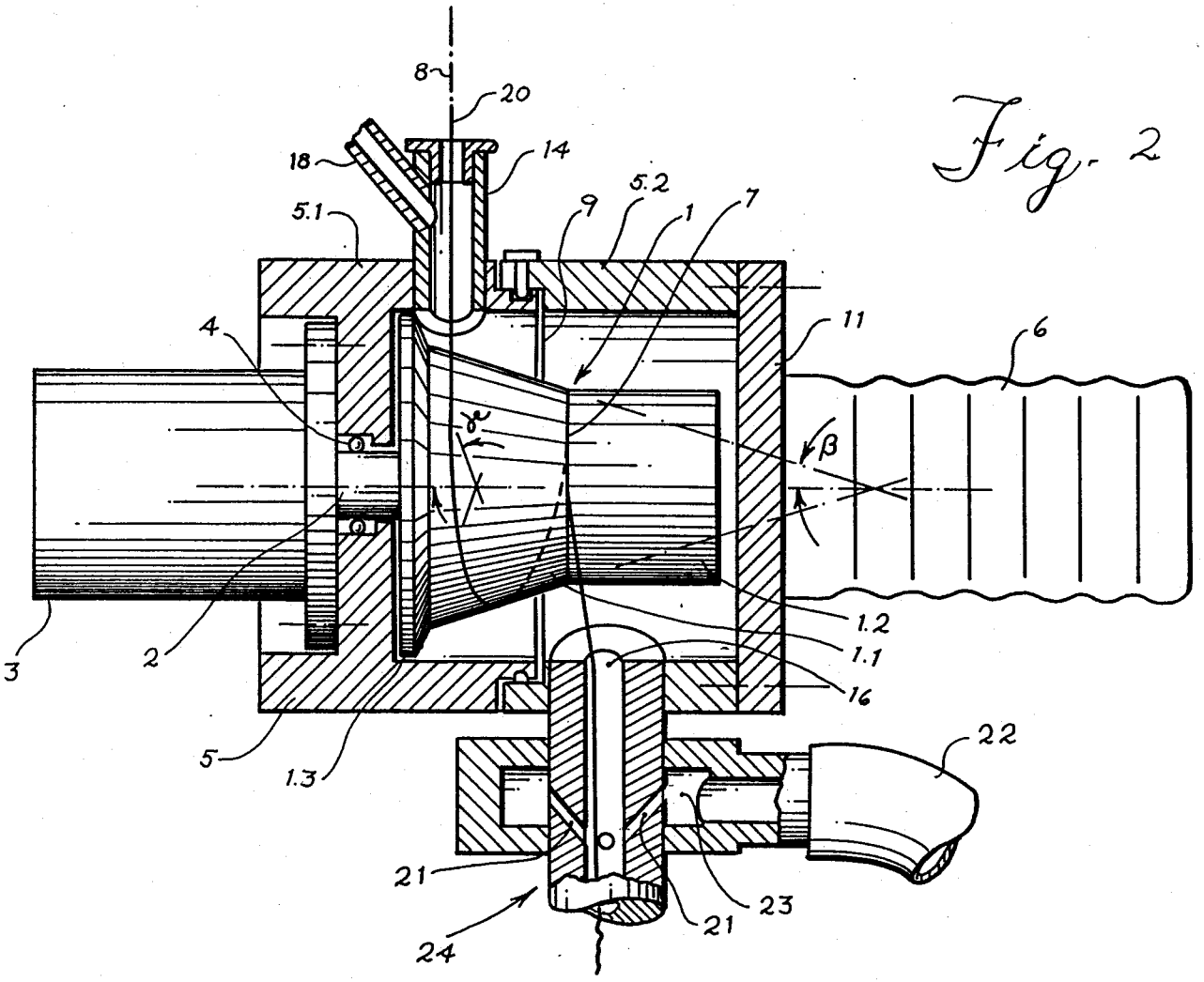
FIG. 2 is a view similar to FIG. 1 and illustrating a second embodiment of the invention.

As shown in FIG. 2, the above conditions are also met by the use of a cylindrical yarn exit portion 1.2. However, in comparison therewith, a conical yarn exit portion 1.2 has the advantage that yarn remnants, which may have accumulated on the yarn exit portion, may be easily removed from the roll by removing the cover plate 11 from the housing 5.

In the embodiments of FIGS. 1 and 2, the housing is composed of two sections 5.1 and 5.2 which are joined to each other for relative rotation about the rotational axis of the roll. The section 5.1 generally overlies the yarn inlet portion of the roll and it includes the yarn inlet opening 14. The other section 5.2 mounts the yarn outlet opening 16. The two sections are joined along a plane 9 which in the illustrated embodiment is located in the yarn entry portion of the roll. Also, the sections 5.1 and 5.2 overlap each other with concentric annular extensions, so that no gap or projecting edge is present in the area of the joining plane and the inner surface of the housing. The extension of the section 5.1 of the housing is provided with a circular, radially inwardly directed groove 12, which is engaged by several radial guide pins 10 which are mounted about the circumference of the extension of the section 5.2.

To now describe the operation of the apparatus of the present invention, the yarn entry opening 14 and the yarn outlet opening 16 are initially placed in the position as shown in FIG. 3. Thus the inlet opening 14 and the outlet opening 16 are located substantially in a common secantial or tangential plane of the housing 5. Compressed air is then supplied to the injectors via the supply line 18 and the supply line 22, with the suction capacity of the injectors 21 at the outlet opening being preponderant. As a result, a yarn held in the yarn inlet opening 14 is drawn into the yarn inlet opening, through the housing, and then withdrawn from the housing through the outlet opening 16 and to a waste container (not shown). The entry section 5.1 of the housing is then rotated by a certain angle, for example, by 360° in the direction of looping, and as a result, the yarn forms a loop of about the same angle, for example, 360° about the roll 1. Thus the yarn is then withdrawn by the tension exerted by the roll 1, and this tension may be adjusted to a large extent by the speed which is applied by the motor 3 and/or by said angle. Preferably, the roll is rotated at a rate such that the initial point of contact of the yarn on said yarn entry portion has a linear speed at least equal to that of the advancing yarn. The yarn initially advances onto the roll 1 in the yarn entry plane 8, i.e. a normal plane, without being able to slide off of this normal plane under its own tension. As a result, a considerable tension is exerted on the yarn. However, in the course of looping about the roll 1, the effects of a transverse force on the advancing yarn cause the yarn to slide laterally along the yarn entry portion 1.1 in a curve in the direction of the taper. As a result, the yarn speed regulates itself to a substantial extent.

The remaining length of the yarn looping about the roll 1 is disposed in the normal plane 7, i.e. the yarn exit plane. The yarn exit plane is located at the transition or interface between the yarn entry portion and the yarn exit portion. The yarn is not able to leave this exit plane, since the yarn slides into the plane from the yarn entry portion, and it tends to move up along the yarn exit portion in the direction toward the yarn entry portion due to its adhesion on the yarn exit portion. The yarn exit plane is constant irrespective of the yarn characteristics in the case of a discontinuous interface between the yarn entry portion 1.1 and the yarn exit portion 1.2 as shown in FIGS. 1 and 2. This will also apply when the opening 16 of the suction device 24 is axially displaced relative to the yarn exit plane. In this latter instance, the yarn will be deflected between the yarn exit plane 7 and the suction opening 16, in the manner shown in FIG. 2. To avoid this deflection, which may under certain circumstances lead to undesirable yarn tension, the suction opening 16 may also be positioned in the yarn exit plane 7 as shown in FIG. 1.

As shown in dashed lines at 25 in FIG. 1, the surface of the yarn entry portion 1.1 and the yarn exit portion 1.2 may alternatively be formed of a continuous, smoothly curved and tapered surface. For example, the tapered surface 25 may take the form of a hyperbola, parabola, circular arc, or the like, with the dimensioning of the inclination remaining within the parameters described above. In this embodiment, a continuous transition results between the yarn entry portion 1.1 and the yarn exit portion 1.2, but this is of no consequence, inasmuch as for any particular yarn a definite yarn exit plane will result in the zone of the transition between the static friction and the sliding friction. However, in the embodiment having a continuous transition, the location of the yarn exit plane is dependent on the yarn characterstics, such as the frictional characteristics of the yarn. This being the case, it is usually preferable to utilize a discontinuous transition between the two portions of the roll.

Figure 4:
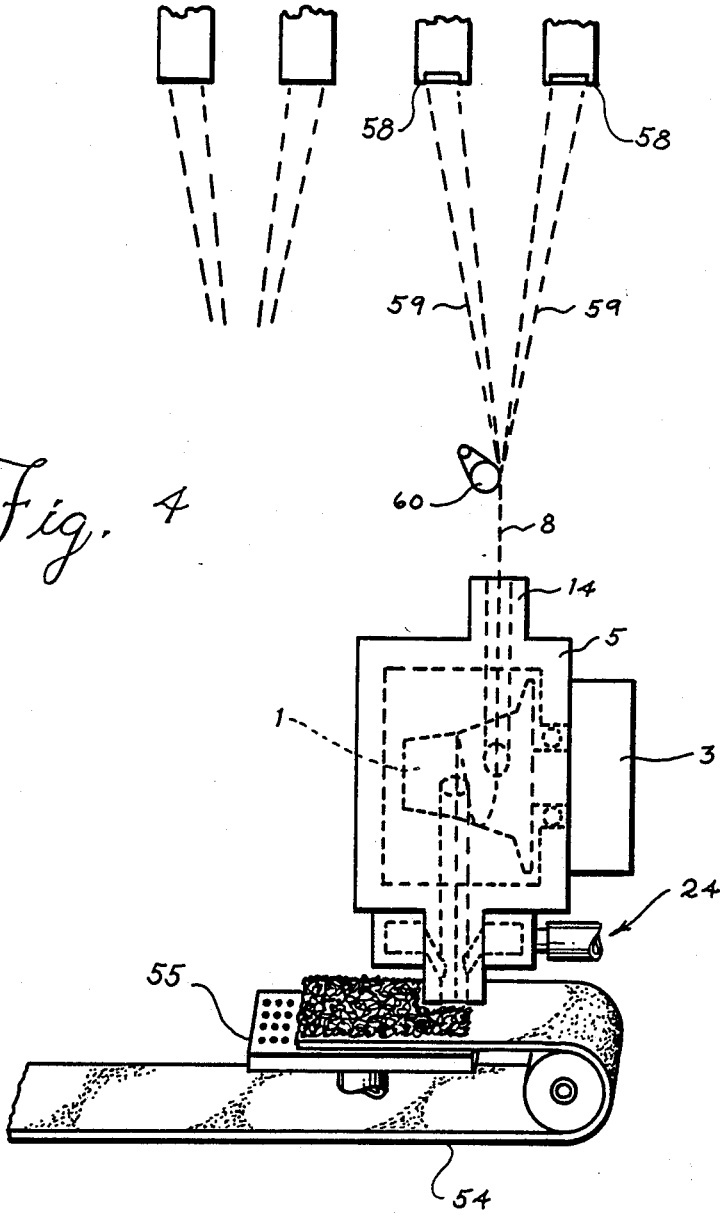
FIG. 4 is a schematic illustration of the yarn withdrawal apparatus of the present invention in association with a spinning apparatus for producing a felt or web of synthetic fibers.

FIG. 4 shows in a somewhat exaggerated scale, a yarn withdrawal apparatus in accordance with this invention and which is integrated into a spinning plant for producing a felt or a web of synthetic fibers. The construction of the withdrawal apparatus closely corresponds to the embodiment shown in FIG. 1. The spinning apparatus comprises two spinning dies 58 for spinning polymeric filaments 59 of, e.g., polyethylene terephtalate, polyamide, polyethylene, etc. The filaments may be withdrawn by a godet. However, the godet preferably is omitted, since the withdrawal apparatus as per this invention is adapted to exert a well defined constant tension on the filaments and to entrain the filaments at a defined constant speed. Thus, the filaments are integrated by means of a thread guide 60 to form a thread 8 which is withdrawn through inlet 14 by means of the roll 1 and is delivered by means of the suction device 24 to a continuous moving belt 54. The continuous belt is supported between two rollers, one of which is shown and one of which is driven by a suitable motor at a moderate speed. The belt is air permeable, and a suction device 55 is positioned along the lower surface of the belt. Thus, the filaments emerging from the suction device 24 are deposited in the form of a felt-like or web-like structure. The structure may further be treated in a suitable manner to form a nonwoven structure which is used, for example, for diapers, clothing, filters, lining, etc. Such suitable measures are not described herein, since they are not part of this invention.

There may, furthermore, be provided means for imparting a back-and-forth motion to either the housing 5 or to the yarn emerging from the suction device 24 to evenly distribute the filaments over the width of the belt 54.

The apparatus of the present invention is particularly adapted for forming a web, since it is adapted for running at a high constant speed, and since it is easy to thread a plurality of filaments to the device, and especially, since it is possible to withdraw the filaments from the spinnerets at a tension causing sufficient orientation, on the one hand, and to deliver the filaments to the belt without any tension, on the other hand. It is, furthermore, of high importance that the apparatus operates at a low energy consumption, since the suction device is operated only at low pressure and low air consumption, since it only needs to exert a very moderate tension on the yarn, and excessive waste of energy is avoided.

Figure 5:
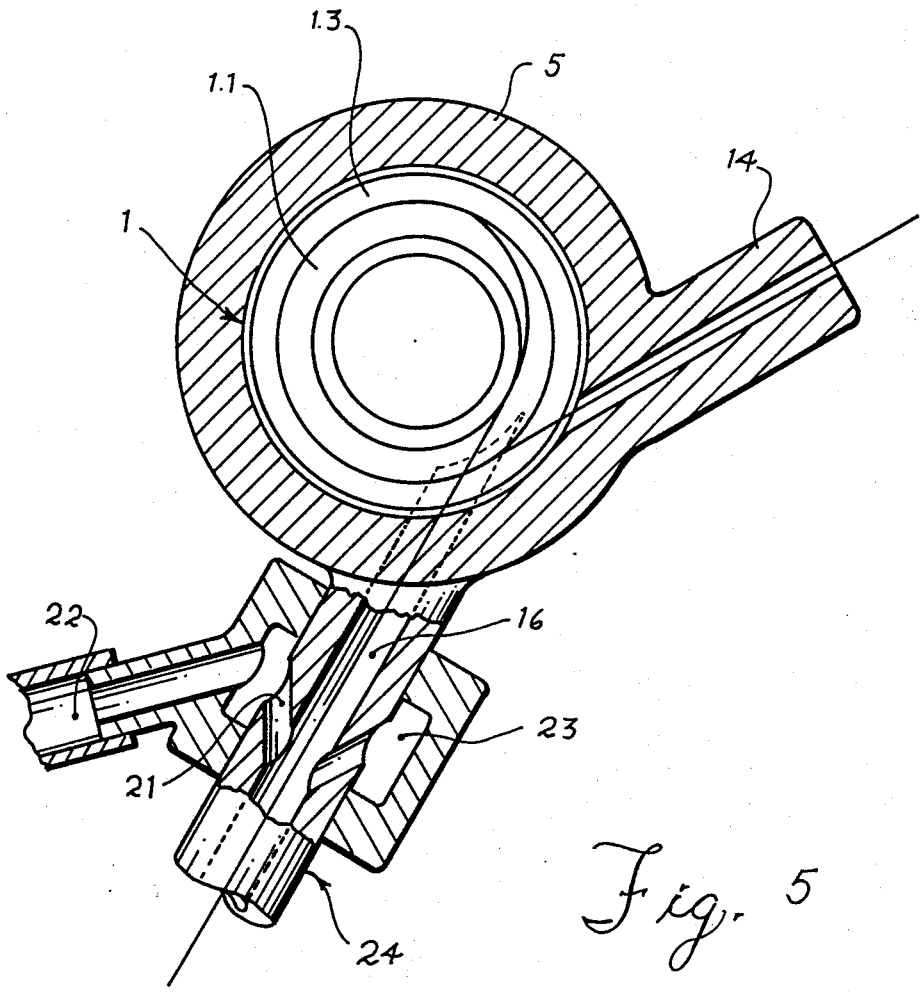
FIG. 5 is a sectional end view of the yarn withdrawal apparatus of FIG. 4.
Figure 6:
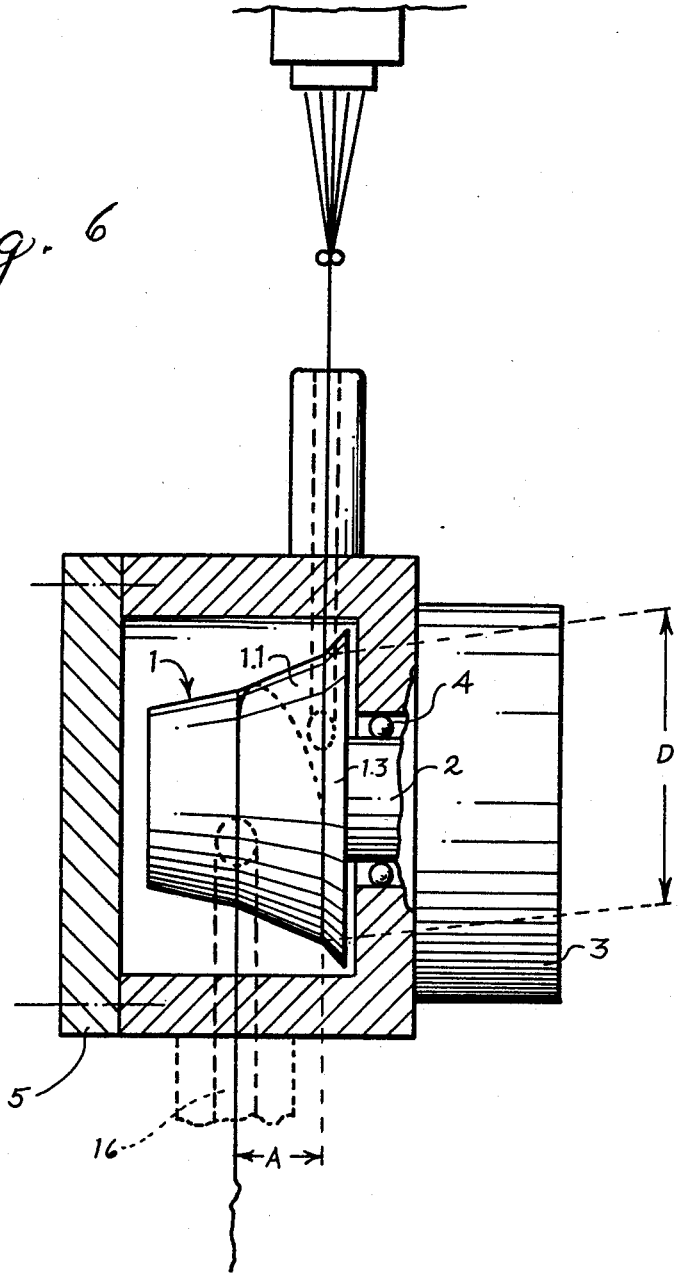
FIG. 6 is a partly sectioned side elevation view of the yarn withdrawal apparatus of FIG. 4.

The embodiment of FIGS. 5 and 6 is similar to the one shown in the previous drawings. The yarn withdrawal apparatus comprises a tapered roll 1 having a drive shaft 2 which is rotatably supported in a bearing 4, and with the bearing in turn being mounted in a cylindrical housing 5 which encloses the roll 1. The roll is driven by the motor 3, and the housing includes a yarn inlet opening 14 and an outlet opening 16 to which a suction device 24 is connected. The suction device includes a tube having a plurality of injector nozzles 21 which receive compressed air from the connection 22 and duct 23.

The tapered roll 1 includes a collar 1.3, a yarn inlet portion 1.1, and a yarn exit portion 1.2, with the inlet portion and exit portion having cone angles of the values described above with respect to the embodiment of FIG. 1. The collar 1.3 has a cone angle, the tangent of which is greater than the coefficient of static friction. It is thereby achieved that the yarn cannot climb up the collar 1.3. In a preferred embodiment, the tangent of the cone angle of the collar is greater than about 0.7.

In contrast to the embodiments described previously, the housing 5 of the embodiment of FIGS. 5 and 6 is a rigid structure. The inlet opening 14 and the outlet opening 16 have a defined fixed position relative to each other and are axially offset from each other. As shown in FIG. 5, the inlet opening and the outlet opening in the projection on the plane of drawing form an angle between them which is less than 180°. It is thereby achieved that the yarn wraps around roll 1 by less than 360°. The angle is adjusted in such a way that the angle of wrap is preferably between about 280°and 340°. It has been found that by this construction, it can be assured that the yarn, when threaded to the apparatus, will wrap the roll and will not be directly sucked from the inlet opening to the outlet opening. In can, furthermore, be assured by this construction that the yarn at the exit portion of the roll will not come too close to the yarn running onto the roll, which would lead to a "wrapper," wherein the yarn end exiting the roll would be clamped on the roll by the yarn end running onto the roll.

For the same purpose, the distance A between the axis of the inlet opening and the axis of the outlet opening is at least ¼ of the diameter D of the tapered roll 1 in that normal plane, in which the yarn runs onto the roll 1. The relation A/D may be chosen between 2 and 6.

In the embodiment of FIGS. 5 and 6, the plane in which the yarn runs onto the roll essentially coincides with the interface between the collar 1.3 and the yarn entry portion 1.1. The other normal plane, in which the yarn exits the roll, essentially coincides with the interface between the yarn entry portion and the yarn exit portion. With this arrangement, the yarn is first guided into the edge between the collar 1.3 and the yarn entry portion 1.1. As explained above, the yarn cannot slip down the yarn entry portion, and it is therefore trapped in that same edge to wrap the roll at a wrapping angle which may be as great as 180°. After a certain angle of wrap the forces transverse to the yarn axis exerted by the yarn end exiting the roll are high enough to overcome the friction forces of the yarn entry portion 1.1 of the roll. Therefore, the yarn then is moved from the plane of yarn entry into a bow to the normal plane of yarn exit. In view of the conical shape of the yarn entry portion 1.1, the tension in that bow of yarn between the normal plane of yarn entry and the normal plane of yarn exit will decrease, which is advantageous, since only this decreased tension will have to be applied to the suction device.

Furthermore, in the embodiment of FIGS. 5 and 6, the plane in which the yarn leaves the roll essentially coincides with the interface between the yarn entry portion 1.1 and the yarn exit portion 1.2 of the roll. Here again, the yarn has a stable position, since by the force of the suction device the yarn on the one side slips down the yarn entry portion 1.1, whereas it cannot slip down the yarn exit portion and rather tends to climb up the conical yarn exit portion.

In the drawings and specification, there has been set forth a preferred embodiment of the invention, and although specific terms are employed, they are used in a generic and descriptive sense only and not for purposes of limitation.

We claim:

1. Apparatus for withdrawing continuously advancing yarn, comprising a support, a tapered yarn winding roll mounted to said support for rotation about a central axis and including a yarn entry portion and a yarn exit portion, with the yarn entry portion having a cone angle which is greater than the cone angle of the yarn exit portion, yarn inlet means for guiding the advancing yarn substantially tangentially onto said roll at said yarn entry portion, yarn outlet means for withdrawing the advancing yarn substantially tangentially from said roll at a withdrawal location axially spaced from said inlet means in a direction toward said yarn exit portion, drive means mounted to said support for rotating said roll about said central axis at a rate such that the initial point of contact of the yarn upon said yarn entry portion has a linear speed at least equal to that of the advancing yarn, and wherein the cone angle of said yarn entry portion has a tangent which is less than the coefficient of static friction between the yarn and the surface of the roll but greater than the coefficient of sliding friction, and the cone angle of said yarn exit portion has a tangent which is less than the coefficient of sliding friction.

2. The apparatus as defined in claim 1 wherein said yarn entry portion and said yarn exit portion are each conical.

3. The apparatus as defined in claim 1 wherein said yarn entry portion is conical and said yarn exit portion is substantially cylindrical.

4. The apparatus as defined in claim 1 wherein said yarn entry portion and said yarn exit portion define a distinct discontinuity at their interface, and wherein said location at which the yarn is withdrawn from said roll corresponds to said distinct discontinuity.

5. The apparatus as defined in claim 1 wherein said yarn entry portion and said yarn exit portion are composed of a continuous, smoothly curved and tapered surface.

6. The apparatus as defined in claim 1 wherein said roll includes a circumferential collar on the end of said yarn entry portion opposite said yarn exit portion.

7. The apparatus as defined in claim 6 wherein said collar is conical and has a cone angle, the tangent of which is greater than the coefficient of static friction between the yarn and the surface of said collar.

8. The apparatus as defined in claim 7 wherein said tangent of said cone angle of said collar is greater then 0.7.

9. The apparatus as defined in claim 1 wherein said yarn outlet means comprises suction means for exerting a tension force on the yarn leaving said yarn exit portion.

10. The apparatus as defined in claim 1 wherein said support includes a housing enclosing said roll, and wherein said yarn inlet means comprises an inlet opening in said housing, and said yarn outlet means comprises an outlet opening in said housing.

11. The apparatus as defined in claim 10 wherein said roll includes a circumferential collar and wherein said yarn entry portion and said collar define an interface therebetween, and wherein said inlet opening in said housing is arranged in the plane of said interface.

12. The apparatus as defined in claim 10 wherein the largest diameter of said yarn entry portion of said roll is about 2 to 6 times the axial distance between the normal planes in which the inlet opening and the outlet opening of said housing are located.

13. The apparatus as defined in claim 10 wherein said inlet opening and said outlet opening form an angle therebetween which is less than 180° when viewed along the rotational axis of said roll and so that the yarn is adapted to wrap around the roll by less than 360°.

14. The apparatus as defined in claim 10 wherein said angle between said inlet and outlet openings is such that the yarn is adapted to wrap around the roll by between about 280° and 340°.

15. The apparatus as defined in claim 10 wherein both said inlet opening and said outlet opening are disposed so as to be substantially tangent to the surface of said roll.

16. The apparatus as defined in claim 10 wherein said yarn inlet means further comprises means for directing an air current inwardly through said inlet opening, and said yarn outlet means further comprises means for directing an air current outwardly through said outlet opening.

17. The apparatus as defined in claim 10 wherein said housing is composed of two sections which are joined to each other for relative rotation about said central axis, with said inlet opening being mounted on one of said sections and said outlet opening being mounted on the other of said sections.

18. The apparatus as defined in claim 1 wherein the cone angle of said yarn entry portion has a tangent which is between about 0.2 and 0.7, and the cone angle of the yarn exit portion has a tangent which is less than about 0.2.

19. The apparatus as defined in claim 18, wherein the tangent of said yarn entry portion is not more than about 0.4.

20. The apparatus as defined in claim 19, wherein the tangent of said yarn exit portion is between about 0.1 and 0.18.

21. Apparatus for withdrawing continuously advancing yarn, comprising a support housing having an interior chamber, a yarn winding roll mounted to said housing within said chamber for rotation about a central axis, said roll including a yarn entry portion and a yarn exit portion, yarn inlet opening means for guiding the advancing yarn through said housing and substantially tangentially onto said roll at said yarn entry portion, yarn outlet opening means mounted to said housing for withdrawing the advancing yarn substantially tangentially from said roll at a location axially spaced from said yarn inlet opening means, drive means mounted to said housing for rotating said roll about said central axis at a rate such that the initial point of contact of the yarn upon said yarn entry portion has a linear speed at least equal to that of the advancing yarn, and said support housing being composed of two sections which are joined to each other for relative rotation about said central axis, with said yarn inlet opening means being mounted to one of said sections and said yarn outlet opening means being mounted to the other of said sections.

22. The apparatus as defined in claim 21 wherein said one section of said housing generally overlies said yarn entry portion of said roll and said other of said sections generally overlies said yarn exit portion of said roll.

23. The apparatus as defined in claim 22 wherein said yarn inlet opening means comprises an opening extending through said one section of said housing and means for directing an air current inwardly through said inlet opening, and said yarn outlet opening means comprises an outlet opening extending through said other of said sections of said housing and means for directing an air current outwardly through said outlet opening.

24. The apparatus as defined in claim 21 wherein at least said yarn entry portion of said yarn winding roll is tapered.

25. Apparatus for withdrawing continuously advancing yarn comprising a support, a yarn winding roll mounted to said support for rotation about a central axis and including a yarn entry portion and a yarn exit portion, with the yarn entry portion having a cone angle which is greater than the cone angle of the yarn exit portion, yarn inlet means for guiding the advancing yarn substantially tangentially onto said roll at said yarn entry portion, yarn outlet means for withdrawing the advancing yarn substantially tangentially from said roll at a withdrawal location axially spaced from said inlet means in a direction toward said yarn exit portion, drive means mounted to said support for rotating said roll about said central axis at a rate such that the initial point of contact of the yarn upon said yarn entry portion has a linear speed at least equal to that of the advancing yarn, said support including a housing enclosing said roll, and wherein said yarn inlet means comprises an inlet opening in said housing, and said yarn outlet means comprises an outlet opening in said housing, with said inlet opening and said outlet opening forming an angle therebetween which is less than 180° when viewed along the rotational axis of said roll and so that the yarn is adapted to wrap around the roll by an angle less than 360° and means operatively connected to said housing for generating airflow inwardly through said inlet opening and outwardly through said outlet opening to facilitate threading of the yarn about said roll.

26. The apparatus as defined in claim 25 wherein said angle between said inlet opening and said outlet opening is such that the yarn is adapted to wrap around the roll by an angle between about 280° and 340°.

27. The apparatus as defined in claim 26, wherein said yarn winding roll includes a collar having a cone angle, the tangent of which is greater than the coefficient of static friction between said yarn and the surface of said collar, the yarn entry portion being conical and having a cone angle which is greater than the cone angle of the yarn exit portion, the cone angle of said yarn entry portion having a tangent which is less than the coefficient of static friction between the yarn and the surface of the roll, but greater than the coefficient of sliding friction, and the cone angle of said yarn exit portion having a tangent which is less than the coefficient of sliding friction.

28. A method of withdrawing continuously advancing yarn utilizing a rotatable tapered roll having a yarn entry portion and a yarn exit portion, with the yarn entry portion having a cone angle which is greater than the cone angle of the yarn exit portion, and comprising the steps of guiding the advancing yarn tangentially onto the yarn entry portion of the roll, while rotating the roll at a rate such that the linear speed of the point of initial yarn contact with the roll is at least equal to the delivery speed of the advancing yarn, looping the advancing yarn by not more than about 360° about the circumference of the roll, while causing the yarn to initially engage to the rotating roll without lateral slippage immediately upon contact with the yarn entry portion of the roll so as to permit the rotating roll to exert a strong tension on the advancing yarn, and to then slip laterally along the surface of the roll in a direction toward said yarn exit portion and to a withdrawal location on the roll which is axially spaced from the point at which the yarn initially contacts the roll, and tangentially withdrawing the advancing yarn from said withdrawal location of said roll.

29. The method as defined in claim 28 wherein the causing step includes selecting the cone angle of the yarn entry portion of the roll so as to have a tangent which is less than the coefficient of static friction between the yarn and the roll surface but greater than the coefficient of sliding friction, and selecting the cone angle of said yarn exit portion so as to have a tangent which is less than the coefficient of sliding friction.

30. The method as defined in claim 29 wherein the step of guiding the advancing yarn onto the yarn entry portion includes entraining the yarn in a moving air current.

31. The method as defined in claim 30 wherein the step of looping the advancing yarn about the roll includes guiding the air current and entrained yarn so as to loop about the roll by more than 180°.

32. The method as defined in claim 31 wherein the step of tangentially withdrawing the yarn includes entraining the yarn in a suction air current.

33. The method as defined in claim 29 wherein said yarn entry portion and said yarn exit portion define an interface therebetween, and said withdrawal location is adjacent said interface.

* * * * *